United States Patent [19]

Sneider

[11] 4,286,735

[45] Sep. 1, 1981

[54] SQUEEZE DISPENSER WITH FLEXIBLE CONDUIT WITH ATTACHED, WEIGHTED AND GROOVED END

[76] Inventor: Vincent R. Sneider, 3422 Hampton Hall, Atlanta, Ga. 30319

[21] Appl. No.: 66,439

[22] Filed: Aug. 14, 1979

[51] Int. Cl.[3] ..... B05B 11/04; B67D 5/60

[52] U.S. Cl. ..... 222/189; 222/211; 222/215; 222/464; 239/327

[58] Field of Search ..... 222/189, 206, 211, 214, 222/215, 376, 382, 464, 479, 566–568; 128/232; 239/327, 590; 215/1 A, 229

[56] References Cited

U.S. PATENT DOCUMENTS

| | | | |
|---|---|---|---|
| 2,571,504 | 10/1951 | Vuillemenot | 222/211 X |
| 3,184,118 | 5/1965 | Webster | 222/189 |
| 3,411,674 | 11/1968 | Gould | 222/215 |
| 4,024,992 | 5/1977 | Schmid | 222/211 |
| 4,069,950 | 1/1978 | Archer | 222/211 X |

FOREIGN PATENT DOCUMENTS

| | | | |
|---|---|---|---|
| 735659 | 8/1955 | United Kingdom | 222/211 |

*Primary Examiner*—Robert J. Spar
*Assistant Examiner*—Fred A. Silverberg
*Attorney, Agent, or Firm*—Ralph R. Roberts

[57] ABSTRACT

There is shown a hand operated fluid and/or powder dispenser and as an preferred embodiment includes a plastic squeeze container having longitudinally fluted ribs for easy collapsing. In the interior there is carried a flexible feeding tube having an end which lies against the bottom of the container. This tube has a weighted enlarged inlet formed with a multiplicity of channels. This container is filled with fluid or powder and has a screw cap retainer in which is mounted a ball valve. This valve is movable to two limits. At an inner limit air or atmosphere flows inwardly when the container is allowed to relax to its molded condition. When the container is squeezed a ball valve is moved to a closed condition whereby airpressure rapidly builds up within the container and the fluid or powder is caused to flow through the flexible tubing to a directing spout. This spout is readily mounted in the cap portion and is movable in relation to the cap by a knurled or fluted knob. In an alternate embodiment the spout may have a fan-like flare exit by which powder is sprayed or distributed from the container. The end of the inlet tube is constructed so as to have a weighted cap inlet which in one embodiment is snapped in place on a shoulder and in another instance is a solid metal disk secured in place in a recess formed in an inlet end.

7 Claims, 8 Drawing Figures

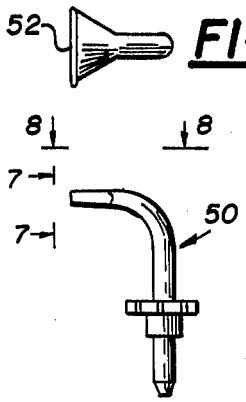
FIG. 6
FIG. 8
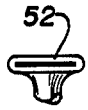
FIG. 7
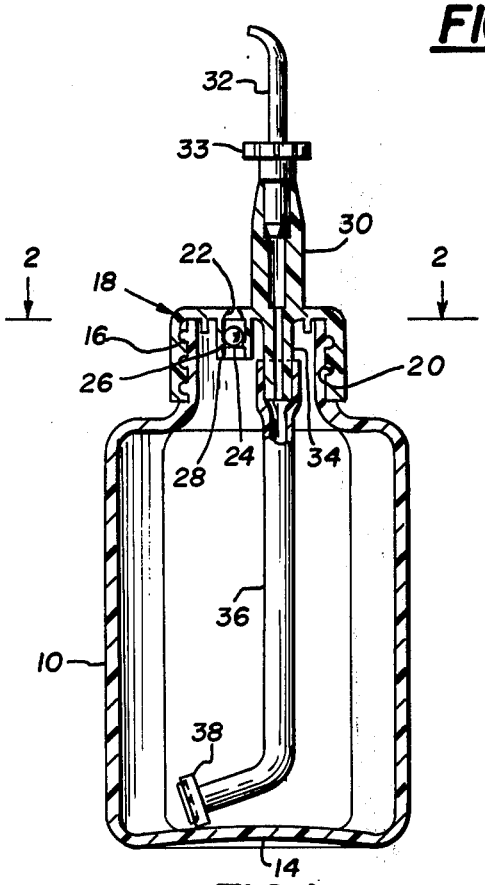
FIG. 1
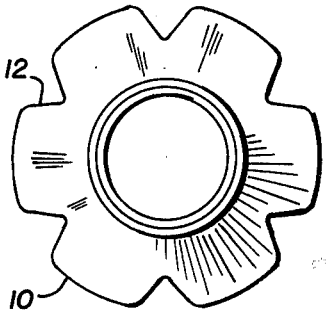
FIG. 2
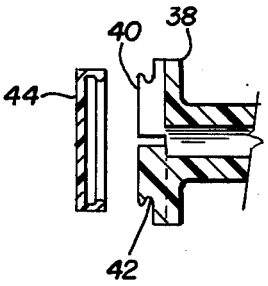
FIG. 3
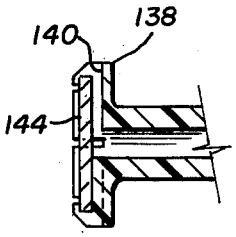
FIG. 4
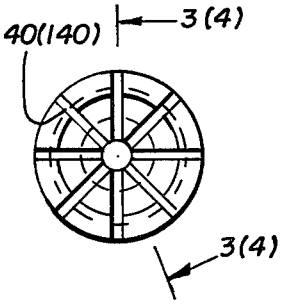
FIG. 5

SQUEEZE DISPENSER WITH FLEXIBLE CONDUIT WITH ATTACHED, WEIGHTED AND GROOVED END

BACKGROUND OF THE INVENTION

1. Field of the Invention

With relation to the field of art as established by and in the U.S. Patent Office, the present invention is believed to be found in the General Class entitled "Dispensing" (Class 222) and the Subclass entitled "resilient wall" (Subclass 206) and "Internally extending outlet pipe" (Subclass 211).

2. Field of the Art

Hand operated spray devices are not new and are shown in many patents. Power actuated spray devices such as Water-Pic and the like are also well known. In the present invention it is contemplated that the container may be of plastic with fluted sides preferably formed with a screw type thread for the one outlet. The sides of the container are fluted for easy collapse by the grasping in the hand of an adult or a child. A simple valve is provided in the cap so that air may readily enter the container but when squeezed the valve means moves into the shutoff condition so that pressure within the container is readily brought to an amount sufficient to force up the fluid or powder within the container to the inlet conduit and out a spout. A jet spray stream may be directed forward by this disclosed pressure. In an alternate embodiment this pressure may be used to carry powder up the flexible tubing to a powder applicating spout. The hand held collapsible containers known to applicant may include an enlarged end. In the present invention this enlarged end has a plurality of grooves leading from the outer diameter to the substantially central conduit and hollow stem. This enlarged end is formed and is weighted so that this end rests at and upon the bottom of the container.

SUMMARY OF THE INVENTION

This invention may be summarized at least in part with reference to its objects. It is an object of this invention to provide, and it does provide, a fluted plastic container having a screw opening upon which is threaded a cap member. This cap member has provision for an outlet spout and on its inside is secured a flexible tube having an enlarged and weighted end whereby the flexible tube is guided to and kept by gravity on the bottom of the container. A ball check valve, restricting outflow of the air in the container, is also provided.

In brief, the present invention contemplates a molded container having fluted sides and a comparatively flat bottom. The top of this container is molded with a screw thread around the outside of an opening formed thereon. A threaded cap means, also of molded plastic, has an upstanding outer conduit disposed to receive a discharge and a jet nozzle which has a very small aperture formed in its discharge end. This discharge may be bent at sixty degrees from the vertical. On the inside of this cap member is a ball valve which is moved to seat in a conical aperture to seal the aperture and any flow of air from the interior of the container. This ball obstructs the outflow of air and is also designed to drop back into a short passageway by way of and through which air may flow to the interior of the container.

On the inside of this cap and in the fluid connecting alignment of the discharge outlet is a short tubular portion upon which is mounted a flexible tube or conduit by which and through which fluid and/or powder is carried from the lower end of the container to the outlet or spout. The end of this flexible tubing has an enlarged and weighted end. In this end are radial guideways formed into and through which fluid and/or powder may be caused to enter the conduit and flow from the container. A weighted cover is attached or secured to this enlarged end to provide a weighting of this inlet tube so that it rests upon the bottom of the container as and when the container is put into use.

In addition to the above summary the following disclosure is detailed to insure adequacy and aid in understanding of the invention. This disclosure, however, is not intended to cover each new inventive concept no matter how it may later be disguised by variations in form or additions or further improvements. For this reason there has been chosen a specific embodiment of a hand operated dispenser as adopted for use for fluid and/or powder and showing a preferred means of construction. This specific embodiment has been chosen for the purposes of illustration and description as shown in the accompanying drawing wherein:

BRIEF DESCRIPTION OF THE DRAWINGS

FIG. 1 represents a side view, largly in section, and diagrammatically showing the construction of the container and the components as used for a fluid spray or jet stream to be directed from the container;

FIG. 2 represents a plane view taken on the line 2—2 of the container of FIG. 1 and showing only the container absent the cap member and the flexible conduit;

FIG. 3 represents a fragmentary, sectional, side view and showing the enlarged inlet end of the conduit and a metal cap as used to cover the end of the radial fluting, this view taken on the line 3—3 of FIG. 5 and looking in the direction of the arrows;

FIG. 4 represents a sectional side view and showing an enlarged end of the inlet conduit with a weighted metal disk forced into place and closing the end of the plastic inlet, this view taken on the line 4—4 of FIG. 5 and looking in the direction of the arrows;

FIG. 5 represents an end view showing the molded flutes in the enlarged end of the conduit;

FIG. 6 represents an alternate side view of a discharge spout particularly adapted for the dispensing of the powder;

FIG. 7 represents an end view taken on the line 7—7 of FIG. 6 and looking in the direction of the arrows and showing an outlet from which powder is dispensed from the container, and FIG. 8 represents a plan or top view, partly fragmentary and diagrammatic and showing in particular the configuration of the spout of FIG. 6 as it is arranged to spray powder therefrom, this view taken on the line 8—8 of FIG. 6 and looking in the direction of the arrows.

In the following description and in the claims various details are identified by specific names for convenience. These names are intended to be generic in their application. Corresponding reference characters refer to like members throughout the eight figures of the drawing.

The drawing accompanying, and forming part of, this specification disclose details of construction for the purpose of explanation but structural details may be modified without departure from the concept and principles of the invention and the invention may be incorporated in other structural forms than shown.

DESCRIPTION OF THE PREFERRED EMBODIMENT

Referring now to the drawing and in particular to FIGS. 1 and 2, there is depicted a flexible container 10 having flutes 12 arranged longitudinally for the easy gripping and squeezing of the container by an adult or child. This container preferably has a bottom 14 which is sufficiently flat for placing and positioning the container for storage. The top of this container 10 is formed with a thread 16. A cap member generally identified as 18 is formed with a screw thread 20 which mates with the thread 16 formed on the container 10. In this cap member is formed an aperture 22 which has a tapered outer end. This aperture or passageway is sized to freely carry a ball 24 and retains this ball by a shoulder portion 26 formed in a tubular portion 28.

Extending upwardly and outwardly from cap member 18 is a tubular conductor 30 which is sized to receive and retain a spout 32 which is generally made of a substantially rigid plastic. This jet spout has a small outlet so as to direct the fluid stream exiting therefrom. In and inwardly of this cap member 18 and in alignment with the tubular conductor 30 is a tubular member 34 on which a non-rigid plastic tubing 36 is secured thereto. The end of this plastic tubing 36 contains or has mounted thereto a molded inlet 38. This inlet 38 as depicted in FIG. 3 is formed with eight flutes or grooves 40. The outer rim of this enlarged inlet is formed with an undercut 42 on which is mounted or snapped in place a disk-like closure 44 which covers the grooves 40 but leaves the end portions of these slots open so as to carry fluid or powder to the interior of the plastic tubing 36.

USE AND OPERATION

Referring now to the container and the fluid or powder that is stored therein, it is contemplated that the container 10 may be stood upright and the cap member 18 removed therefrom. With removal of this cover or cap the interior components are also removed so only the container 10 remains. A measured amount of fluid or powder is then placed in the container and the cap member 18 is placed thereupon. If fluid is to be dispensed from this container then a jet spout 32 is mounted in and through the entryway of the tubular conductor 30. A knurled portion 33 allows the spout to be oriented into the desired position. The tapered end of this spout is forced into the tubular conductor 30 whereupon it is brought to a shoulder position as seen in FIG. 1.

To expell fluid from the container it is contemplated that the container be more-or-less in an upright position and the sides of the container squeezed so that the fluted portion 12 is caused to collapse inwardly. At this same time an increase of air pressure in the container causes the ball 24 to move upwardly to the tapered seat of aperture 22 to close this outlet and allow a pressurized buildup to occur in the container causing fluid to flow through the grooves 40 and into the passageway of the flexible plastic tubing 36 thence into the conduit of the inward tubular member 34 and thence to and through spout 32. After a determined amount of fluid has been expelled the grip on the collapsed container is relaxed to the extent that the container is allowed to assume its original "as formed" contour or shape. When this occurs the ball 24 falls away from the seat of aperture 22 and allows air to pass down the tubular portion 28 into the interior of the container. A repeat actuation of the squeezing action of the container allows a jet stream of fluid to pass out the spout 32. Preferably the fluid in the container may be very liquid, such as water, for the use as a spray cleaning for the teeth and the like. In its weighted condition the molded inlet 38 as shown has an enlarged end which rests upon or substantially engages the bottom 14 of the container 10 so that the container is substantially emptied by the repeated actuation (squeezing) of the container 10.

It is also to be contemplated that the container 10 may be used for the storing and dispensing of powder in which case a spout 50, such as seen in FIGS. 6, 7 and 8, is contemplated to be used. This spout 50 has a flat outer end portion 52 for the distribution and spraying of the powder and the spout can be readily mounted in the tubular conductor 30. Powder is expelled through the plastic tubing 36 and out the spout 50 by pressurized air as above described.

The weight provided for the enlarged end 38 is preferably secured by a metal cap such as the disk-like closure 44 as seen in FIG. 3 which is snapped in place over the undercut 42. The grooves 40 formed in this molded enlarged end are shown as eight radially disposed grooves but may be more or less as is desired. In FIG. 4 there is shown an alternate embodiment in which the enlarged end 138 has grooves 140 formed therein. A metal disk 144 is a snug fit into a recess formed in this enlarged end 138 and closes off the grooves 40 except for the end openings. The use of a disk-like closure 44 or a metal disk 144 insures that the enlarged ends 38 or 138 are sufficiently weighted to rest upon or substantially be carried to the bottom 14 of the container.

It is to be noted that the plastic container and disk-like closure are not shown with a gasket or washer but it is contemplated that the mounting of the disk-like closure on the container thread 16 will be sufficiently tight to close this disk-like closure and container so that air, fluid or powder do not pass along the threaded connnection thereof. The simple valve shown with this cap contemplates the use of the plastic ball 24 and a simple retention of this ball in the shoulder portion 26 by a molding technique readily available. Flapper valves using a movable piece of plastic or tear shaped design are also well known and the selection of a one-way valve means is only a matter of choice since many valves are known and may be used. It is contemplated that the container 10 be made of flexible plastic or rubber so that it can readily be collapsed when squeezed and the walls thereof have retentive strength to move to its "as molded" condition when and where desired.

The enlarged end 38 or 138 is contemplated as being separately molded for removable mounting in the flexible plastic tubing 36. This enlarged end is preferably made of plastic but a metal or metal carrying embodiment may be used. The vertical flutes 12 and the bottom 14 of the container 10 are merely suggested configurations and changes within the scope of the accompanying claims may be made. The enlarged end may be formed with radial passageways such as by molding or drilling thus providing a substitution for the molded grooves 40 or 140. It is only necessary that the enlarged end be weighted and a few of the inlets be exposed to the fluid or powder in the container.

Terms such as "up", "down", "bottom", "top", "front", "back", "in", "out" and the like are applicable to the embodiments shown and described in conjunction with the drawing. These terms are merely for the purposes of description and do not necessarily apply to the position in which the hand held and actuated dispenser may be constructed or used.

While a particular embodiment of the dispenser and alternate embodiment of the spout and enlarged ends have been shown and described it is to be understood the invention is not limited thereto since modifications may be made within the scope of the accompanying claims and protection is sought to the broadest extent the prior art allows.

What is claimed is:

1. A hand held squeeze dispenser for fluid and/or powder which includes:

(a) a flexible container having an outlet at one end and with the sidewall portions thereof longitudinally fluted so as to be readily collapsible by manipulation such as squeezing to reduce the interior volume of the container, said container having the sidewall portion sufficiently stiff to return unassisted to an "as formed" condition and shape after said collapsing actuation;

(b) a closure cap mounted on the outlet of the container, said mounted cap adapted to retain the contents of the container absent spillage and leakage when and while the container is maintained in substantially an upright condition;

(c) an outlet of generally tubular construction formed in and on said cap so as to receive and retain a discharge spout;

(d) a valve carried in said cap and adapted to close under the influence of air being moved from the container as the container is collapsed and to open and pass air into the interior of the container through said valve when the container is relaxed to resume and assume said "as formed" condition;

(e) a conduit retainer of generally tubular configuration and formed on the inner side of the cap, said conduit retainer in flow communication with the outlet of the cap;

(f) a flexible plastic tubing attached to said conduit retainer on the inside of the cap, said flexible tubing providing a flow passageway through said tubing, the conduit retainer and thence to the outlet, said flexible tubing of a length sufficient to bring its unconnected end to at least a proximate relationship with the bottom of the container when and while in a stored condition;

(g) an enlarged end provided on the unconnected end of the flexible tubing, said enlarged end being a molded component with a substantially central passageway extending to the flexible tubing and providing a common conducting flow passageway from the enlarged end to the flexible tubing, said enlarged end and the central passageway including radially disposed grooves formed in an open face portion of the enlarged end, said grooves extending from the outer periphery of the enlarged end to the substantially central passageway, and (h) a cover member and means for securing said cover to the open end of said enlarged end, said cover so constructed and configured that when secured the grooves are covered except for their outer end portions and providing radial conducting paths, said enlarged end and cover providing sufficient weight to carry the flexible tubing and its connected enlarged end to the bottom of the container when and while in a substantially upright condition.

2. A hand held squeeze dispenser as in claim 1 in which the discharge spout is mountable in the cap outlet and is adapted to discharge fluid in a spray or jet stream.

3. A hand held squeeze dispenser as in claim 1 in which the discharge spout mountable in the cap outlet is contoured to discharge powder as a spray-like stream.

4. A hand held squeeze dispenser as in claim 1 in which the valve is a ball carried in a tubular passageway, said passageway formed with a tapered reduced portion providing a non-locking sealing seat when the ball is pressed thereagainst by air pressure as developed by a collapsing of the container and to provide an air passageway as the dispenser moves toward said "as formed" condition.

5. A hand held squeeze dispenser as in claim 1 in which said cover member is a metal cover.

6. A hand held squeeze dispenser as in claim 5 in which the enlarged end is formed with said grooved face having an undercut at the outer ends of the grooves and the cover is a metal cap which is mountable in said undercuts to retain the cap.

7. A hand held squeeze dispenser as in claim 5 in which the enlarged end is formed with said grooved face having a recess formed therein and the cover is a metal disk mountable in said recess to cover said groove portions interior of said outer extents and leaving only the ends of the grooves open to the contents of the container for the discharge through the flexible conduit.

* * * * *